US005150500A

United States Patent [19]

Bisbing

[11] Patent Number: 5,150,500

[45] Date of Patent: Sep. 29, 1992

[54] ADJUSTABLE LIFT-OFF HINGE

[75] Inventor: Robert H. Bisbing, Springfield, Pa.

[73] Assignee: Southco, Inc., Concordville, Pa.

[21] Appl. No.: 728,346

[22] Filed: Jul. 11, 1991

[51] Int. Cl.[5] ..... E05D 7/04

[52] U.S. Cl. ..... 16/239; 16/247; 16/252; 16/265; 16/262; 16/382; 16/387; 16/DIG. 39

[58] Field of Search ..... 16/221, 229, 234, 235, 16/239, 240, 241, 247, 252, 253, 262, 265, 270, 382, 386, 387, DIG. 29, DIG. 39, 260

[56] References Cited

U.S. PATENT DOCUMENTS

| | | | |
|---|---|---|---|
| D. 263,370 | 3/1982 | Bisbing . | |
| D. 263,446 | 3/1982 | Bisbing . | |
| D. 268,733 | 4/1983 | Bisbing . | |
| D. 269,943 | 8/1983 | Bisbing . | |
| D. 278,309 | 4/1985 | Vickers . | |
| D. 303,491 | 9/1989 | Bisbing . | |
| D. 303,492 | 9/1989 | Bisbing . | |
| 4,490,884 | 1/1985 | Vickers . | |
| 4,630,332 | 12/1986 | Bisbing . | |
| 4,630,333 | 12/1986 | Vickers . | |
| 4,785,498 | 11/1988 | Brotschi | 16/DIG. 39 |
| 4,827,568 | 5/1989 | Ramsauer | 16/382 |
| 4,937,916 | 7/1990 | Redman | 16/261 |

FOREIGN PATENT DOCUMENTS

| | | | |
|---|---|---|---|
| 2039307 | 2/1972 | Fed. Rep. of Germany | 16/235 |
| 2217932 | 3/1973 | Fed. Rep. of Germany | 16/265 |
| 2230557A | 10/1990 | United Kingdom | 16/241 |

OTHER PUBLICATIONS

Southco Fasteners Handbook 37 (Southco, Inc. Pennsylvania 1987) pp. L-20 through L-23.

*Primary Examiner*—John Sipos
*Assistant Examiner*—Donald M. Gurley
*Attorney, Agent, or Firm*—Paul and Paul

[57] ABSTRACT

An adjustable lift-off hinge comprises a support member having a longitudinal axis mounted onto a frame. A knuckle assembly mounted onto a door is provided having a longuitudinal adjustable knuckle member rotatably coupled to the support member along the longitudinal axis, and a longitudinal fixed base member having a convex outer surface pivotally connected to a longitudinal side of the adjustable knuckle member.

30 Claims, 3 Drawing Sheets

ADJUSTABLE LIFT-OFF HINGE

FIELD OF THE INVENTION

The present invention generally relates to a hinge assembly for use on doors. More particularly the invention relates to a lift-off hinge in which the axis of rotation of the hinge is adjustable relative to the door and frame to which the hinge is affixed.

BACKGROUND OF THE INVENTION

Lift-off hinge assemblies are known in the art and are particularly useful for securing a door, cover or the like to a frame surface.

One problem associated with the use of such hinges, however, is the inability to adjust to accommodate door assemblies which employ gaskets or other seals between the frame and the door. In such circumstances, it is advantageous to have an adjustable hinge in order to accommodate a range of thickness of the gaskets and to maintain the gasket under compression even if it undergoes a change in thickness caused by its continuous compression during use.

It is therefore an object of the present invention to provide a lift-off hinge that is adjustable.

Adjustable hinges, as such, are known in the art and have been typically used on door assemblies which employ gaskets or other seals between the frame and the door.

One type of adjustable hinge utilizes lateral slots as mounting apertures for mounting a hinge knuckle to the closure member, thus permitting side-to-side adjustment of the knuckle which, in turn, varies the distance between the closure member and its frame.

Another known adjustable hinge employs a two-piece base assembly in which the base of the two-piece assembly is affixed to the closure member and second piece of the base is mounted to the first piece. The two pieces of the base are designed such that they are allowed to be adjusted with respect to each other before tightening.

Another type of hinge, though not "adjustable" employs shims which are used for spacing the axis of rotation from the frame.

It has been observed that a problem associated with the use of such hinges is that when adjustment of the hinge is desired, while the hinge is still supporting the door, it is very difficult due to the load of the door.

It is therefore another object of the present invention to provide an adjustable hinge capable of being easily adjusted.

Another problem associated with the use of the prior art hinges is that because the hinge carries the load of the door during its adjustment, the resultant adjustment is oftentimes inaccurate such that the axis of rotation of the hinge is not parallel to the mounting surfaces of both the door and frame, causing binding of the door.

It is therefore a further object of the present invention to provide an adjustable hinge capable of being accurately adjusted so as to prevent misalignment of the door.

These and other objects of the invention will become apparent to one skilled in the art upon a further reading of the specification, including the detailed description of the embodiments with reference to the drawings and the appended claims.

SUMMARY OF THE INVENTION

Briefly stated, the present invention comprises a support member, adapted to be mounted onto a door assembly, having a longitudinal axis, and at least one generally planar mounting surface. A knuckle assembly, rotatably coupled about the longitudinal axis of the support member, is also provided. The knuckle assembly includes, in combination, a longitudinal adjustable knuckle member, and a longitudinal fixed base member, the fixed base member having at least one generally planar mounting surface for mounting the fixed base member onto a door of the door assembly, and the fixed base member further includes a generally convex outer surface, pivotally coupled to the adjustable knuckle member. Rotatable coupling means are provided for rotatably coupling the support member to the knuckle assembly. Pivotal coupling means are also provided for pivotally coupling the convex outer surface of the fixed base member to the adjustable knuckle member.

BRIEF DESCRIPTION OF THE DRAWINGS

The foregoing summary, as well as the following detailed description will be better understood when read in conjunction with the appended drawings. For the purpose of illustrating the invention, there is shown in the drawings embodiments which are presently preferred, it being understood, however that this invention is not limited to the precise arrangement and instrumentalities shown.

DESCRIPTION OF THE PREFERRED EMBODIMENTS

Figure 1:
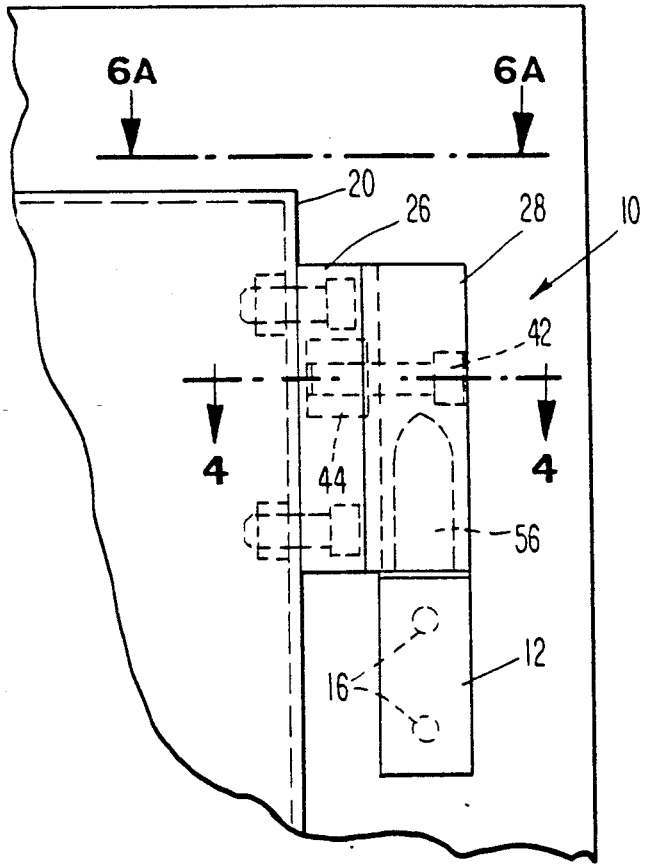
FIG. 1 is a side elevational view partially shown in phantom, of one embodiment of the present invention, as applied to a cabinet or the like, comprising, in combination, a support member, a longitudinal adjustable knuckle member, and a fixed base member.

Referring to the drawings, wherein like numerals indicate like elements throughout, there is shown in FIG. 1 an adjustable lift-off hinge assembly referred to generally by reference numeral 10. The adjustable lift-off hinge assembly 10 comprises a support member 12 (best seen in FIG. 2) having at least one generally planar mounting surface 14, by which the support member 12 is mounted to a frame 22. The support member 12 is provided with tapped threaded bores 16 located on the planar mounting surface 14, and is mounted to the frame 22 by mounting means commonly known in the art, such as, for example, threaded screws (not shown). In the present embodiment, the support member 12 is generally rectangular in shape and made from stainless steel. It should be understood, however, that the support member 12 can be made to have any suitable shape and be of any suitable rigid material, without departing from the spirit of the invention. A spacer member 18 (best seen in FIGS. 6A and 6B) may also be provided to act in combination with the support member 12 for varying the distance between the the support member 12 and the frame 22 so that it can accommodate varying thicknesses of stripping 54, 54' mounted onto the frame 22 adjacent to a door 20 which is oftentimes used to insulate the door and act as a cushion when the door 20 is closed.

Figure 3:
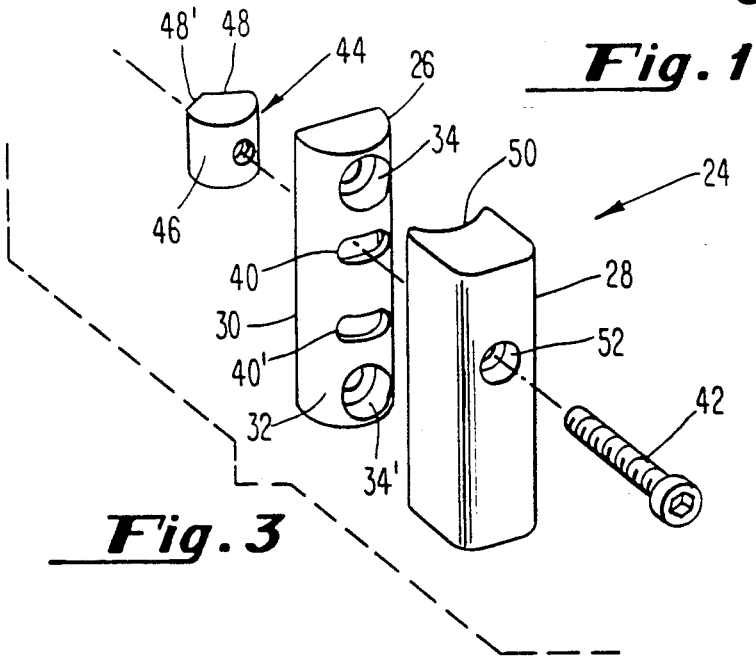
FIG. 3 is an exploded perspective view of one embodiment of the knuckle assembly showing the longitudinal adjustable knuckle member, the longitudinal fixed base member and means for pivotally coupling the adjustable knuckle member to the fixed base member, which in this view includes a threaded screw and multi-sided nut member.
Figure 4:
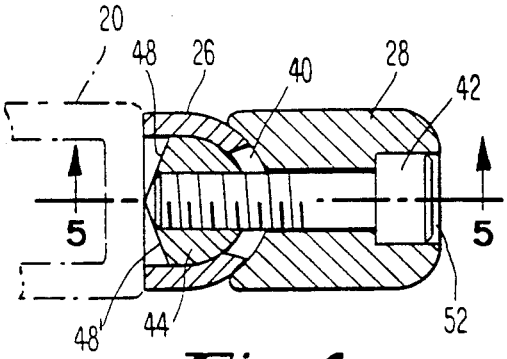
FIG. 4 is a planar, partially cross-sectioned view of the adjustable lift-off hinge assembly taken along line 4—4 of FIG. 1.
Figure 5:
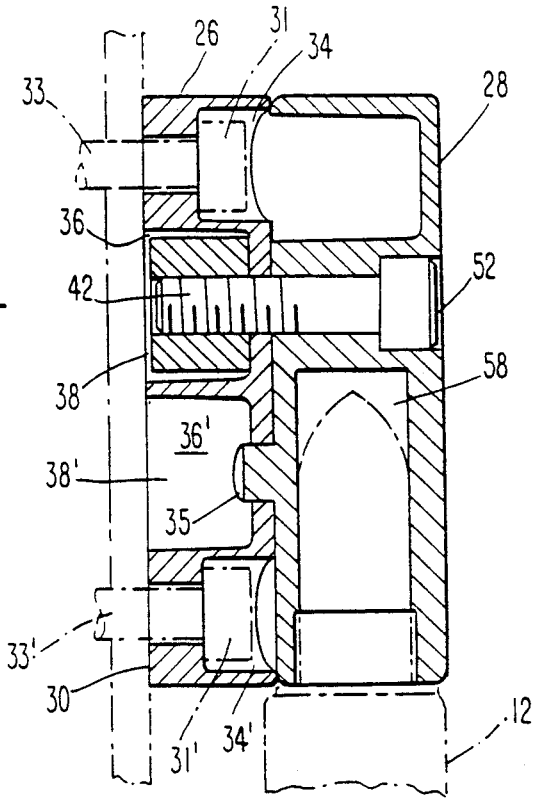
FIG. 5 is a cross-sectioned side elevational view of the adjustable lift-off hinge assembly taken along line 5—5 of FIG. 4.

There is shown in FIG. 3 an exploded perspective view of the knuckle assembly, in accordance with the present embodiment referred to generally by reference numeral 24. The knuckle assembly 24 comprises, in combination, a longitudinal fixed base member 26, a longitudinal adjustable knuckle member 28, and means for pivotally coupling the fixed base member 26 to the adjustable knuckle member 28. In this embodiment, the fixed base member 26 is of equal length to that of the adjustable knuckle member 28, and includes a generally planar outer surface 30 for mounting the fixed base member 26 to the door 20, and a generally convex outer surface 32 to which the adjustable knuckle member 28 is pivotally coupled. Mounting holes 34, 34' are provided for facilitating mounting of the fixed base member 26 to the door 20. The mounting holes 34, 34' are of sufficient depth so that the heads 31, 31' of the threaded screw members 33, 33', when threaded into the mounting holes 34, 34' lies either flush with or below the convex outer surface 32 of the fixed base member 26. The fixed base member 26 further includes two interchangeable coupling chambers 36, 36', (best seen in FIG. 5), one of which is used to receive the pivotal coupling means. The coupling chambers 36, 36' are bored transversely into the fixed base member 26 and include a first open end 38, 38' located flush with the planar outer surface 30 of the fixed base member 26, and a second open end 40, 40' shaped in the form of a slot (best seen in FIG. 3) located flush with the convex outer surface 32 of the fixed base member 26.

The pivotal coupling means used to pivotally couple the fixed base member 26 to the adjustable knuckle member 28 comprises a threaded screw 42 and a threaded nut 44. The threaded nut 44 includes a convex outer surface 46 similar to that of the fixed base member 26, and is disposed within one of the coupling chambers 36, 36' in such a way so that the convex outer surfaces 32 and 46 are contiguous to one another. Distally located from the convex outer surface 46 of the threaded nut 44 are a pair of adjoining outer surfaces 48, 48' (best seen in FIG. 3) which meet at a predetermined angle. It should be noted that while the distally located outer surface in the present embodiment comprises a pair of angularly joined surfaces 48, 48', any type of surface, including a planar one, may be employed without departing from the spirit of the invention.

The adjustable knuckle member 28 of the present embodiment, is longitudinal in shape and comprises a generally concave outer surface 50 which fittingly engages the convex outer surface 32 of the fixed base member 26 to which it is pivotally connected. Such a configuration reduces the friction between the fixed base member 26 and the adjustable knuckle member 28 when the knuckle assembly 24 is slidably adjusted. A through-hole 52 is bored transversely into the adjustable knuckle member 28 in order to receive the threaded screw 42 of the pivotal coupling means. The knuckle assembly 24 is pivotally coupled by inserting the threaded screw 42 through the through-hole 52 of the adjustable knuckle member, and by disposing the threaded nut 44 into one of the coupling chamber 36, 36'. The convex outer surface 32 of the fixed base member is then fittingly engaged to the concave outer surface 50 of the adjustable knuckle member 28. The threaded screw 42 is then threadedly inserted into the threaded nut 44 via the second open end 40 of the coupling chamber 36. In this embodiment, the other coupling chamber 36' is used to receive an abutment means which aids in guiding the knuckle assembly 24 between a fully expanded and fully retracted position. An abutment member 35 connected to and extending outwardly from the concave outer surface 50 of the adjustable knuckle member 28 is inserted into the second open end 40' of the other coupling chamber 38'.

Figure 6A:
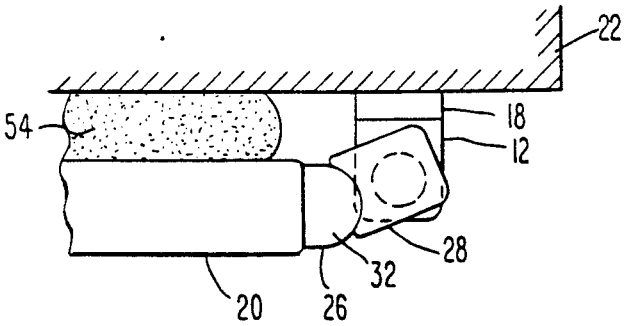
FIGS. 6A and 6B are planar views of the adjustable lift-off hinge assembly as applied to a cabinet or the like, shown in varyingly adjusted positions.
Figure 6B:
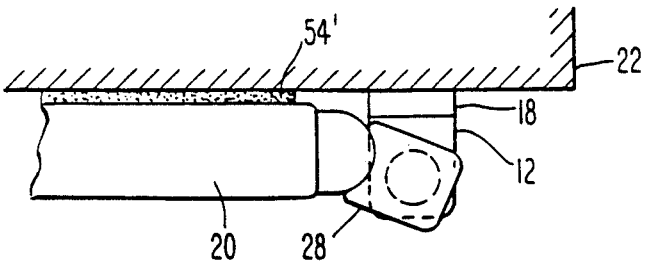

Referring to FIGS. 6A and 6B, the adjustable feature of the present invention is provided by the convex outer surface 32 of the fixed base member 26. The knuckle assembly 24 can be adjusted to either increase or decrease the distance between the door 20 and the frame 22 to which it is mounted in order to accommodate, among other things, varying thicknesses of stripping 54, 54' by sliding the adjustable knuckle member 28 along the convex outer surface 32 of the fixed base member 26. FIG. 6A shows the knuckle assembly 24 pivotally coupled outwardly so as to accommodate stripping 54 of greater thickness, wherein the distance between the door 20 and frame or assembly 22 are increased. FIG. 6B, on the other hand, shows the knuckle assembly pivotally coupled inwardly in order to accommodate thinner stripping 54', wherein the relative distance between the door 20 and frame 22 is decreased. It should be noted that while the support member 12 is shown mounted at a right angle, relative to the knuckle assembly 24, it should be noted that both the support member 12 and the knuckle assembly 24 may be mounted parallel to one another.

Figure 2:
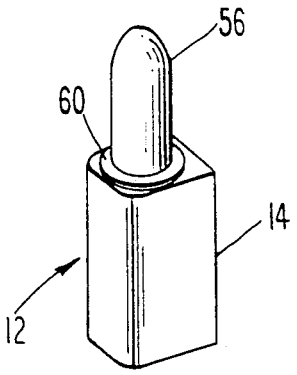
FIG. 2 is a perspective view of the support member, with a pivot pin connected to and extending outwardly from the support member with a washer disposed over it.

As was mentioned previously, the knuckle assembly 24 is rotatably coupled to the support member 12 by rotatable coupling means. FIG. 2 shows one embodiment of the rotatable coupling means comprising a pivot pin 56 connected to, and extending outwardly from a terminal end of the support member. A mating recess 58 is provided in a complimentary terminal end of the adjustable knuckle member (best seen in FIG. 5). In operation, the support member 12 is first mounted onto a frame or assembly 22, with the pivot pin 56 extending upwardly from the support member 12. The fixed base member 26 is then mounted onto the door 20, and then the adjustable knuckle member 28 is pivotally connected to the fixed base member 26, with the mating recess 58 located at a bottom terminal end of the adjustable knuckle member 28. The door 20 is then lifted onto the support member 12 by matingly engaging the mating recess 58 onto the pivot pin 56.

Figure 7:
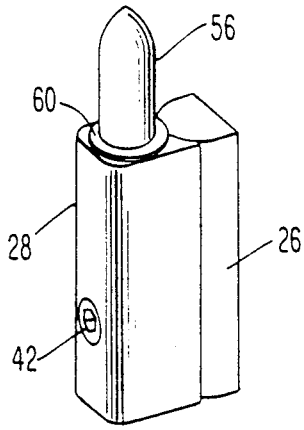
FIG. 7 is a perspective view of an alternate embodiment of the present invention showing the pivot pin connected to and extending outwardly from the longitudinal adjustable knuckle member.

FIG. 7 shows an alternate embodiment of the rotatable coupling means wherein the pivot pin 56 is connected to and extends outwardly from a terminal end of the adjustable knuckle member 28. In this embodiment, the mating recess (not shown) would be provided in a complimentary bottom terminal end of the support member 12. Here, the pivot pin 56 would be inserted down into the mating recess of the support member 12. A third embodiment (not shown) may include two mating recesses located in complimentary terminal ends of both the support member 12 and adjustable knuckle member 28, with the pivot pin 56 not being connected to either, but rather disposal into the first mating recess so that the free end of the first pin 56 may receive the second mating recess. A washer 60 may also be provided over the pivot pin 56 if desired to enhance engagement rotation of the support member 12 relative to the adjustable knuckle member 28. It should be understood that while the present invention uses a pivot pin 56 and mating recess for rotatably coupling the support member 12 to the knuckle assembly 24, any suitable type of rotatable coupling means may be employed, without departing from the spirit of the invention.

Figure 8:
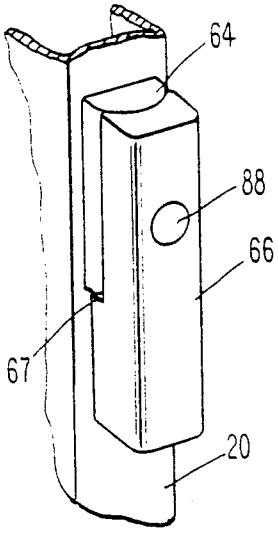
FIG. 8 is a perspective view of the preferred embodiment of the knuckle assembly, shown affixed to a door.
Figure 9:
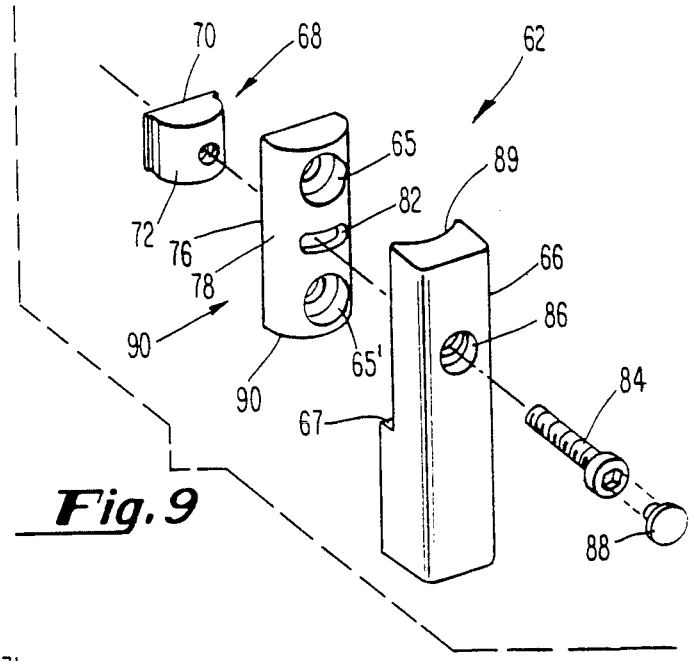
FIG. 9 is an exploded perspective view of the embodiment of FIG. 8.
Figure 10:
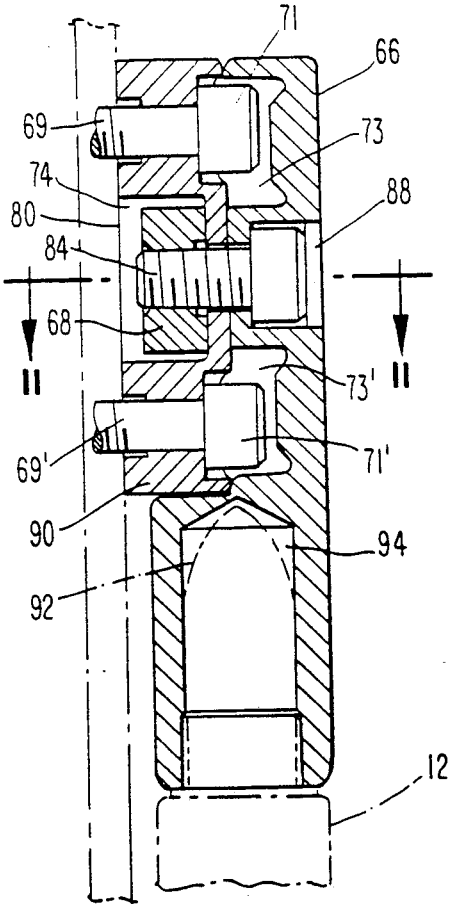
FIG. 10 is a cross-sectioned, view of the preferred embodiment of the knuckle assembly.
Figure 11:
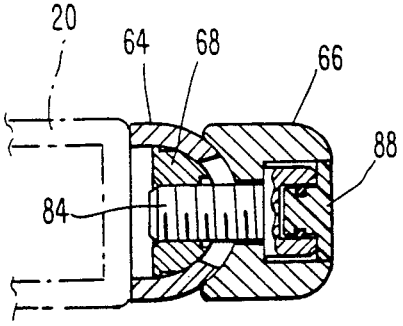
FIG. 11 is a cross-sectioned planar view of the invention, as seen along line 11—11 of FIG. 10.

There is shown in FIGS. 8–11, a preferred embodiment of the knuckle assembly, referred to generally as reference numeral 62. In this embodiment, the knuckle assembly 62 can be mounted closer to the door 20, thereby rendering the entire hinge assembly 10 less bulky (as seen in FIG. 11). FIG. 8 shows the knuckle assembly 62 mounted onto a door or the like. In this preferred embodiment a fixed base member 64 is provided which is shorter in length then an adjustable knuckle member 66, to which it is pivotally connected. The fixed base member 64 is almost identical to that of fixed base member 26, except that it is shorter in length and has shallowly tapped mounting holes 65, 65' bored through the fixed base member 64 so that when the threaded screws 69, 69' are threaded into the mounting holes 65, 65', their respective heads 71, 71' lie above the convex outer surface 78 of the fixed base member 64.

The fixed base member 64 in the preferred embodiment is provided with only a single coupling chamber 74, best seen in FIG. 10, for receiving the nut member 68, as compared to two interchangeable coupling chambers as described in the previous embodiment. The single coupling chamber 74 has a first open end 80 and a second open end 82 shaped in the form of a slot, for receiving a threaded screw member 84. The fixed base member is also provided with a planar outer surface 76 located opposite from the convex outer side 78.

The adjustable knuckle member 66, however, is noticeably different than the adjustable knuckle member 28 in that here it is somewhat L-shaped, due to the presence of a lip portion 67 extending outwardly from the adjustable knuckle member 66 onto which fixed base member 64 will be placed. FIG. 9 shows an exploded view of the knuckle assembly 62, together with a modified pivotal coupling means. The nut member 68 shown here is two-sided, rather than multi-sided as nut member 44, having a flat side 70 and a generally convex side 72, wherein the flat side 70 is slightly larger than the convex side 72 so that terminal ends of the flat side 72 extend slightly beyond those of the convex side.

Regarding the adjustable knuckle member 66, (best seen in FIGS. 9 and 10), a through hole 86 is provided for receiving the threaded screw member 84 of the pivotal coupling means. In the preferred embodiment, the threaded screw member 84 is of the Allen-head variety and may also be provided with a cover member 88 for similarly aesthetic purposes.

The adjustable knuckle member 66 has a concave mating side 89 for fitting engagement with the convex outer surface 78 of the fixed base member 64. Off-set recesses 73, 73' are also provided in the concave mating side 89 in order to receive the heads 71, 71' of the threaded screws 69, 69' which lie above the convex outer side 78 of the fixed base member 64. This enables the knuckle assembly 62 to be slidably adjusted without any interference from heads 71, 71' of the threaded screws 69, 69'. When the fixed base member 64 is pivotally coupled to the adjustable knuckle member 66, a terminal end 90 of the fixed base member 64 rests on the lip portion 67 of the adjustable knuckle member 66, with the convex outer side 78 and the concave mating side 89 being in fitting engagement.

In this preferred embodiment the rotatable coupling means rotatably coupling the knuckle member 66 comprises a pivot pin 92 connected to and extending outwardly from the support member 12. The pivot pin 92 is matingly engaged with a mating recess 94 bored into a terminal end of the adjustable knuckle member 66. It should be noted that the pivot pin 92 can be connected to and extend from the adjustable knuckle member 66 as well, with a mating recess (not shown) being bored into the support member 12. Also, both the support member 12 and adjustable knuckle member 66 may have complimentary mating recesses (not shown) with the pivot pin 92 being disposed therein.

It will be recognized by those skilled in the art that changes may be made to the above-described embodiments of the invention without departing from the broad inventive concepts thereof. It is understood, therefore, that this invention is not limited to the particular embodiment disclosed, but it is intended to cover all modifications which are within the scope and spirit of the invention as defined by the appended claims.

What is claimed is:

1. An adjustable lift-off hinge assembly comprising:

(a) a support member mounted onto a frame, said support member having a longitudinal axis, and further having at least one generally planar mounting surface;

(b) a knuckle assembly mounted onto a door comprising, in combination;

(i) a longitudinal adjustable knuckle member rotatably coupled to said support member along said longitudinal axis; and (ii) a longitudinal fixed base member having at least one generally planar outer surface mounted onto said door, and further having a generally convex outer surface pivotally connected to a longitudinal side of said adjustable knuckle member;

(c) rotatable coupling means for rotatably coupling said support member to said knuckle assembly; and (d) pivotal coupling means for pivotally coupling said convex outer surface of said fixed base member to said longitudinal side of said adjustable knuckle member.

2. The adjustable lift-off hinge of claim 1, wherein said rotatable coupling means comprises a pivot pin connected to, and extending outwardly from a terminal end of said support member, along said longitudinal axis of said support member, and further comprising a mating recess bored into a terminal end of said adjustable knuckle member, for receiving a free end of said pivot pin.

3. The adjustable lift-off hinge of claim 2 further comprising a washer disposed over said pivot pin.

4. The adjustable lift-off hinge of claim 1, wherein said rotatable coupling means comprises a pivot pin connected to, and extending outwardly from a terminal end of said adjustable knuckle member, and further comprises a mating recess bored into a terminal end of said support member, along said longitudinal axis of said support member, for receiving a free end of said pivot pin.

5. The adjustable lift-off hinge of claim 4, further comprising a washer disposed over said pivot pin.

6. The adjustable lift-off hinge of claim 1, wherein said rotatable coupling means comprises, in combination, a first mating recess bored into a terminal end of said support member along said longitudinal axis, and a second mating recess bored into a complimentary terminal end of said adjustable knuckle member, and a pivot pin disposed within both said first and second mating recesses.

7. The adjustable lift-off hinge of claim 6, further comprising a washer disposed over said pivot pin.

8. The adjustable lift-off hinge of claim 1, wherein said fixed base member further comprises at least one coupling chamber bored transversely into said fixed base member for facilitating said pivotal coupling means for pivotally coupling said convex outer surface of said fixed base member to said adjustable knuckle member, said coupling chamber having a first open end located flush with said planar outer surface of said fixed base member, and a second open end located flush with said convex outer surface of said fixed base member at a distal transverse end of said coupling chamber, said second open end being in the form of a slot.

9. The adjustable lift-off hinge of claim 8, wherein said pivotal coupling means comprises, in combination, a threaded screw and threaded nut member, said threaded nut member having at least one concave side.

10. The adjustable lift-off hinge of claim 9, wherein said threaded nut member is disposed within said coupling chamber through said first open end of said coupling chamber so that said concave side of said threaded nut member lies flush with an inner wall of said second open end of said coupling chamber, and said threaded screw is inserted through both said through-hole of said adjustable knuckle member, and an outer wall of said second open end of said coupling chamber, where it threadedly engages said threaded nut member.

11. The adjustable lift-off hinge of claim 8, further comprising a second coupling chamber located below said first coupling chamber for receiving an abutment means.

12. The adjustable lift-off hinge of claim 1 wherein said support member further comprises a removable spacer member adapted to be disposed between said planar mounting surface of said support member and said frame.

13. The adjustable lift-off hinge of claim 1, wherein said support member and said knuckle assembly are mounted at a right angle to each other.

14. The adjustable lift-off hinge of claim 1 wherein said longitudinal adjustable knuckle member further comprises at least one concave outer surface adapted to receive the convex outer surface of said longitudinal fixed base member.

15. An adjustable lift-off hinge assembly comprising:

(a) a support member mounted onto a frame, said support member having a longitudinal axis, and further having at least one generally planar mounting surface;

(b) a knuckle assembly mounted onto a door comprising:

(i) a longitudinal adjustable knuckle member having a lip portion extending outwardly from a lower longitudinal side of said adjustable knuckle member; and (ii) a longitudinal fixed base member having at least one generally planar outer surface mounted onto said door, and having a terminal end resting on said lip portion of said adjustable knuckle member, and further having pivotal coupling means for pivotally connecting a generally convex outer surface of said longitudinal fixed base member to said adjustable knuckle member; and (c) means for rotatably coupling said support member to said adjustable knuckle member.

16. The adjustable lift-off hinge of claim 15, wherein said rotatable coupling means comprises a pivot pin connected to, and extending outwardly from a terminal end of said support member, along said longitudinal axis of said support member, and further comprises a mating recess bored into a terminal end of said adjustable knuckle member, for receiving a free end of said pivot pin.

17. The adjustable lift-off hinge of claim 16, further comprising a washer disposed over said pivot pin.

18. The adjustable lift-off hinge of claim 15, wherein said rotatable coupling means comprises a pivot pin connected to, and extending outwardly from a terminal end of said adjustable knuckle member, and further comprising a mating recess bored into a terminal end of said support member, along said longitudinal axis of said support member, for receiving a free end of said pivot pin.

19. The adjustable lift-off hinge of claim 18, further comprising a washer disposed over said pivot pin.

20. The adjustable lift-off hinge of claim 15, wherein said rotatable coupling means comprises, in combination, a first mating recess bored into a terminal end of said support member along said longitudinal axis, a second mating recess bored into a complimentary terminal end of said adjustable knuckle member, and a pivot pin disposed within both said first and second mating recesses.

21. The adjustable lift-off hinge of claim 20, further comprising a washer disposed over said pivot pin.

22. The adjustable lift-off hinge of claim 15, wherein said fixed base member further comprises at least one coupling chamber bored transversely into said fixed base member for facilitating means for pivotally connecting said convex outer surface of said fixed base member to said adjustable knuckle member, said coupling chamber having a first open end located flush with said planar outer surface of said fixed base member, and a second open end located flush with said convex outer surface of said fixed base member at a distal transverse end of said coupling chamber, said second open end being in the form of a slot.

23. The adjustable lift-off hinge of claim 22, wherein said pivotal connecting means comprises, in combination, a threaded screw and threaded nut member, said threaded nut member having at least one concave side.

24. The adjustable lift-off hinge of claim 23, wherein said threaded nut member is disposed within said coupling chamber through said first open end of said coupling chamber so that said concave side of said threaded nut member lies flush with an inner wall of said second open end of said coupling chamber, and said threaded screw is inserted through both a through-hole of said adjustable knuckle member, and an outer wall of said second open end of said coupling chamber, where it threadedly engages said threaded nut member.

25. The adjustable lift-off hinge of claim 15, further comprising a removable spacer member adapted to be disposed between said support member and said door assembly.

26. The adjustable lift-off hinge of claim 15, wherein said support member and said knuckle assembly are mounted at a right angle to each other.

27. The adjustable lift-off hinge of claim 15 wherein said longitudinal adjustable knuckle member further comprises at least one concave outer surface adapted to receive the convex outer surface of said longitudinal fixed base member.

28. An adjustable lift-off hinge comprising, in combination, a support member mounted onto a door assembly having a longitudinal axis, and further having at least one generally planar mounting surface; a knuckle assembly comprising a longitudinal adjustable knuckle member rotatably coupled to said support member along said longitudinal axis by rotatable coupling means comprising a first mating recess bored into a terminal end of said support member along said longitudinal axis and a second mating recess bored into a complimentary terminal end of said adjustable knuckle member, and a pivot pin disposed within both said first and second mating recesses; and further comprising a longitudinal fixed base member having at least one generally planar outer surface fixedly mounted onto a door of a door assembly, and having a generally convex outer surface pivotally connected to said adjustable knuckle member by pivotal coupling means and having at least one coupling chamber bored transversely into said fixed base member, said coupling chamber having a receiving open end located flush with said planar outer surface, and a slotted open end at a distal transverse end of said coupling chamber located flush with said convex outer surface, and wherein said pivotal coupling means comprises, in threaded engagement, a threaded nut member disposed within said coupling chamber and a threaded screw inserted through both a through-hole of said adjustable knuckle member and said slotted end of said coupling chamber, thus threadedly engaging said threaded nut member.

29. The adjustable lift-off hinge of claim 28, wherein said support member and said knuckle assembly are mounted at a right angle to each other.

30. The adjustable lift-off hinge of claim 28 wherein said longitudinal adjustable knuckle member further comprises at least one concave outer surface adapted to receive the convex outer surface of said longitudinal fixed base member.

* * * * *